US005377753A

United States Patent [19]

Haberman et al.

[11] Patent Number: 5,377,753

[45] Date of Patent: Jan. 3, 1995

[54] METHOD AND APPARATUS TO IMPROVE THE DISPLACEMENT OF DRILLING FLUID BY CEMENT SLURRIES DURING PRIMARY AND REMEDIAL CEMENTING OPERATIONS, TO IMPROVE CEMENT BOND LOGS AND TO REDUCE OR ELIMINATE GAS MIGRATION PROBLEMS

[75] Inventors: John P. Haberman, Houston, Tex.; Mark Delestatius, New Orleans, La.; Dan G. Brace, Needville, Tex.

[73] Assignee: Texaco Inc., White Plains, N.Y.

[21] Appl. No.: 80,547

[22] Filed: Jun. 24, 1993

[51] Int. Cl.[6] ..... E21B 43/00

[52] U.S. Cl. ..... 166/249; 166/286; 166/177

[58] Field of Search ..... 166/63, 177, 249, 286, 166/285

[56] References Cited

U.S. PATENT DOCUMENTS 4,407,365 10/1983 Cooke, Jr. ..... 166/286 X 5,190,114 3/1993 Walter ..... 166/286 X

*Primary Examiner*—William P. Neuder

*Attorney, Agent, or Firm*—James L. Bailey; Kenneth R. Priem; Russell J. Egan

[57] ABSTRACT

Cement bonding and bond logs in wells are significantly improved by imparting random or periodic, pulsating, oscillating or vibrating pressure to the fluids present during all stages of a cementing operation. The effect is to eliminate gelation of the fluids to improve cement placement and to enable consolidation of the cement slurry. The pressure pulses can also be detected to monitor the condition of the setting slurry.

15 Claims, 3 Drawing Sheets

METHOD AND APPARATUS TO IMPROVE THE DISPLACEMENT OF DRILLING FLUID BY CEMENT SLURRIES DURING PRIMARY AND REMEDIAL CEMENTING OPERATIONS, TO IMPROVE CEMENT BOND LOGS AND TO REDUCE OR ELIMINATE GAS MIGRATION PROBLEMS

BACKGROUND OF THE INVENTION

1. The Field of the Invention

The present invention relates to methods and apparatus to improve four important aspects of cementing casing in a well bore. They are discussed in the order that the operations are generally performed in the field: (1) Improved placement of the cement during initial cementing of the casing in the well bore; (2) Preventing gas migration into the cement slurry after placement; (3) Improving the tests used to evaluate cement placement; and (4) Improving the success of remedial cement squeeze operations.

The basic concept of the present invention is to apply a random or periodic, pulsating, oscillating or vibrating pressure to the fluids present at different stages during the cementing operation. The effect is to reduce or eliminate gelation of the fluids.

The tendency of fluids in wells to develop gel strength under static conditions interferes with the cementing operation. One aspect of this invention is the discovery that if fluids are oscillated at the surface of the well, this motion is efficiently transmitted long distances down the well, where it prevents the development of gel strength, or reverses the process of gelation, if it has already occurred earlier in the operation.

2. The Prior Art

After a well has been drilled, casing is typically lowered into the well bore and is cemented in place by pumping a liquid cement slurry into the annular space between the casing and the well bore. This generally requires the displacement of a drilling fluid from the annulus by the liquid cement slurry. Drilling fluid tends to gel under the static conditions that exist just before the cement slurry is pumped downhole. When the cement slurry is pumped into the annular space between the casing and well bore, it may bypass pockets of gelled drilling fluid, leaving incompletely cemented casing.

Several techniques are routinely employed in the oil industry to improve displacement of the drilling fluid in the annulus by the cement slurry. They include thinning and circulating the drilling fluid prior to cementing, rotating or reciprocating the casing before and during cementing, the use of centralizers, etc. All of these methods add significantly to the expense and time required to cement the casing and they may not provide a proportioned improvement in the displacement of the drilling fluid by the cement slurry.

Casing vibration has been shown to improve cement displacement during large scale tests and it has been proposed as a method to prevent gas migration, which is discussed below. A device for commercial application has been constructed. It is a large hydraulically operated device that mechanically supports and vibrates the casing. It is very expensive and difficult to use in the field and has not proved to be a practical device. It has never been used for cementing operations because of its prohibitive cost, but it has had limited success in freeing stuck drill pipe when all other methods have failed.

The migration of gas from gas formations into the cement slurry may occur after the cement has been pumped, but before it has become a solid. This represents a common problem in some fields and may occur on an unpredictable basis in others. The consequences range from "gas cut cement" to blow outs to the surface. The control of gas migration is one of the most costly and challenging technical problems in well cementing.

The basic cause of gas migration is believed to be the loss of hydrostatic pressure within the cement column as it makes the transformation from a liquid slurry to a solid. The development of gel strength in the static column of cement is primarily responsible for this loss of hydrostatic pressure. This loss of hydrostatic pressure allows an influx of formation fluids, usually gas, before the cement has completed the setting process.

Various chemical additives have been tried to control gas migration in cement slurries. Some of these additives appear to be completely ineffective, while others appear to have different degrees of effectiveness. But all are very expensive and most are of limited applicability. Such additives typically increase the cost of cementing casing by a factor of two to five times.

Relatively few mechanical methods have been used to control gas migration and only one is in common use. It involves cementing a short column of cement across a gas zone known to be a problem and leaving a column of drilling fluid over the cement slurry to maintain hydrostatic pressure as the cement sets up. This technique may be used with a cement "staging tool" to complete the cementing operation. This method has enjoyed a degree of success, but it significantly increases the cost and time required.

Gas migration can be prevented if gelation of the cement slurry can be prevented or delayed until the cement slurry develops enough viscosity to prevent the movement of gas within the slurry. This can be accomplished by mechanical agitation. It has been reported that slowly rotating the casing, after the cement has been placed but before the slurry sets up, can prevent gas migration. Clearly this method is limited to applications where casing rotation is practical. Special equipment is required to accurately control the torque. Rotation must be stopped when the drag on the casing at the bottom of the well becomes too high and before torque builds to the point that the casing might be twisted off. This may occur before the cement is viscous enough the prevent gas migration at shallower depths. This is because cement slurries begin to thicken and set up at the bottom of wells first, because the temperature is higher.

Cement bond logs are the primary method used to evaluate the placement of cement between the casing and well bore. For the purpose of this discussion, the term cement "bond log" includes all devices that rely on acoustic logging devices used to evaluate the placement of cement. It also refers to the test results of such a device.

These cement bond logs heretofore have been subject to a number of shortcomings. A good bond log generally means that a good bond has formed between the cement and the pipe or casing, but a poor bond log does not necessarily indicate poor cement placement. There are many reasons why a poor bond log may be obtained, and none of them pertain to the actual cementing of the casing.

Advances are continually being made in the use of acoustic logs, but they all share one major shortcoming, namely they require a very good physical contact between the cement and the casing in order to conduct sound into the cement and formation. A gap of only a few thousandths of an inch between the cement and casing may be detected by the log as no cement at all between the casing and well bore. Any one of a number of processes, such as temperature cycling, cement shrinkage, casing contraction, etc., can cause gaps to form as the cement sets.

If a poor bond log is obtained, remedial cement squeeze operations are generally performed until a satisfactory bond log is obtained. Several squeeze operations may be required. A substantial body of field evidence indicates that these squeeze operations are often unnecessary and that the problem is the bond log rather than the overall quality of the cementing operation. That is to say, the cement bond log is taken to represent the extent of displacement of the drilling fluid by the cement slurry during cement placement and it is overly sensitive to factors that do not relate to the quality of the cementing operation itself.

Strategies have been developed to improve the ability of bond logs to accurately represent the completeness of the drilling fluid displacement by the cement. For example, it is now common practice to run bond logs with the casing pressurized. The expansion of the casing, when pressurized at the surface to pressures of the order of 1,000 to 2,000 psi, may close any "microannulus" that formed during cementing thereby providing an improved bond log.

However, there are also instances where pressurizing the casing does not close this gap. Excess pressure can enlarge a microannulus and/or form cracks in the cement sheath that are detrimental to the seal provided thereby. Expansive cement additives have been developed with the goal to improve bond logs. They have had a more limited application than pressurizing the casing and they may actually reduce the strength of the cement. All of these methods are time consuming and of uncertain reliability.

There are a variety of circumstances where it is desired to "squeeze" cement slurries into areas of a wellbore that are already occupied by gelled fluids, usually drilling fluid. A common example is to repair casing leaks in uncemented sections of casing. In this example, gelled drilling fluid is usually left in the annulus between the casing and the well bore and the objective is to squeeze cement into this annulus to seal off the leak to prevent unwanted formation fluids from leaking into the casing.

During such a squeezing operation, the cement often channels or fingers through the gelled fluid rather than displacing it away from the point of entry in a uniform fashion. Once such a channel has formed, large quantities of slurry will tend to flow through the same channel without displacing the gelled drilling fluid surrounding the channel. The result is an unsuccessful squeeze operation.

Multiple squeezes may be required. This involves squeezing, waiting for the cement to set, drilling out the cement left in the casing, pressure testing, squeezing again, (this time through a different channel,since the first one is full of set cement) etc, until a successful pressure test is obtained. Two or three squeezes are often required for a successful pressure test. Cases have been reported where a dozen or more squeezes were necessary to obtain a successful pressure test.

SUMMARY OF THE INVENTION

It is the objective of this invention to improve cementing operations by applying pressure to the fluid phases that exist in a well during a well cementing operation. An important aspect of the present invention is the finding that, if pressure is applied at the surface of the well, it is efficiently transmitted long distances down the well. This pressure preferably will have a random or periodic, pulsating, oscillating or vibrating component which can have a very rapid (square wave), a more gradual (sinusoidal) or any other type of wave shape. This vibrating component may be a resonant type of vibration, although the invention is not limited to any specific condition of resonance. The action of the pressure is to reduce or eliminate the gelled condition of fluids during the cementing operation.

The present invention also includes direct mechanical coupling by lowering vibration generating devices into the well bore. For example, this might be accomplished during "inner string cementing", by attaching an oscillating or vibrating device to a tubing string lowered into the casing, the device being withdrawn when the cementing operation has been completed. It may also be accomplished by a device lowered on a "wireline". This device might vibrate or oscillate the casing by direct mechanical coupling to the casing as well as by vibrating or oscillating the fluid within the casing.

The present invention can be applied to any of the four aspects of cementing as described in more detail below. It can be separately or concurrently applied to different aspects of cementing operations. It may have additional applications to drilling and cementing operations that are not described in the form of the examples discussed in this specification. The examples described here are provided to illustrate and describe the manner in which this invention may be applied and does not exclude other examples which might occur to those skilled in the art.

One objective of this invention is to improve the bond between the cement and casing so that the cement bond log is more representative of the overall quality of the cementing operation.

BRIEF DESCRIPTION OF THE DRAWINGS

The present invention will now be described, by means of example, with reference to the accompanying drawings, in which.

DETAILED DESCRIPTION OF THE PREFERRED EMBODIMENT

The present invention will now be described with reference to the accompanying drawings which are schematic in nature and are used solely to illustrate the principles of the invention rather than restricting the invention to specific means.

Figure 1:
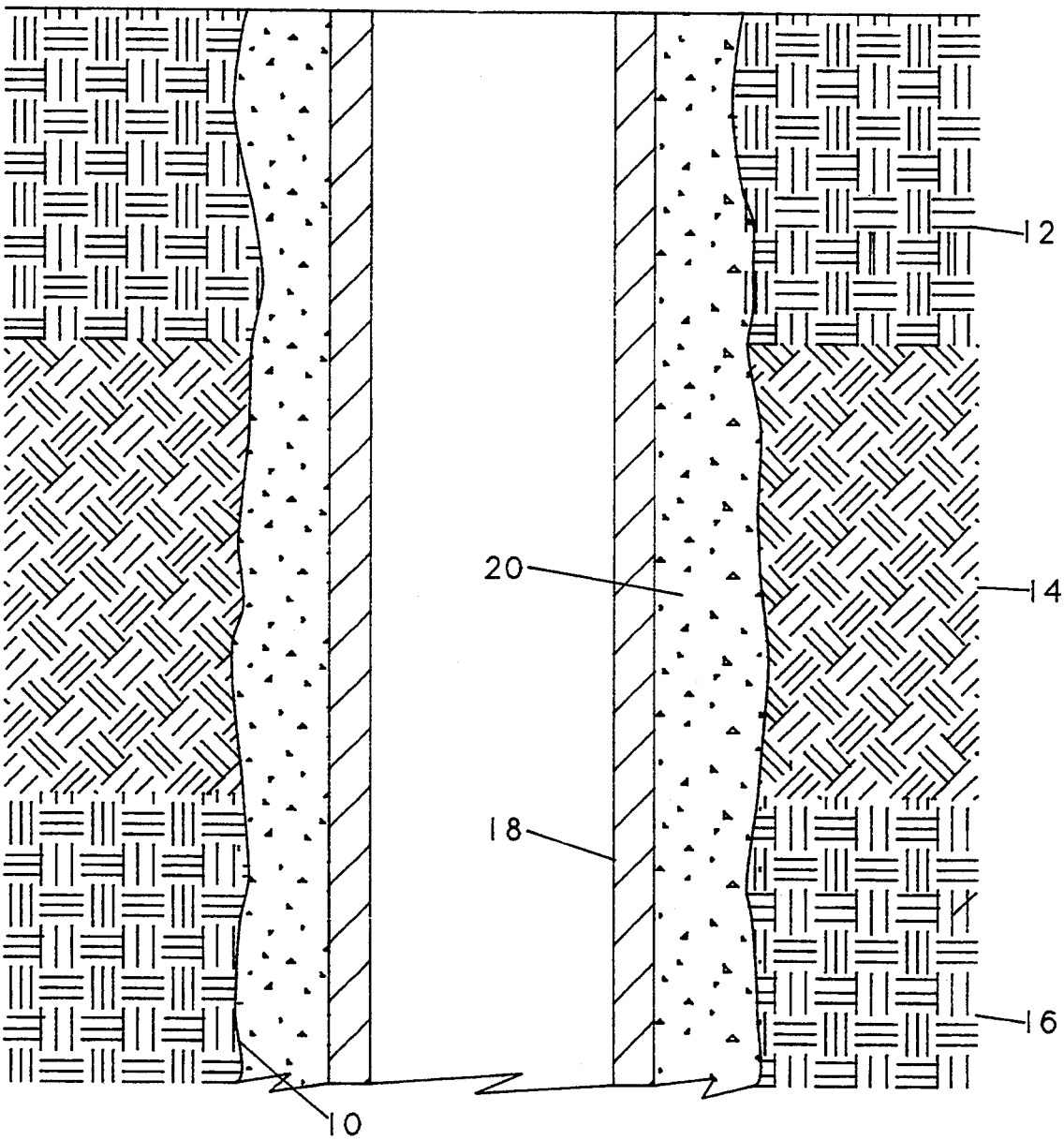
FIG. 1 is a schematic side elevation, partly in section, used to describe the operation of the present invention.

FIG. 1 is a schematic vertical section through a typical well drilled to produce hydrocarbons. The well bore 10 has penetrated a number of strata 12, 14, 16 (not shown to scale). In this instance layer 14 is a gas producing layer which is to be sealed off. A casing 18 is positioned in the wellbore extending at least the length of the strata 14, and cement 20 is placed in the annulus between the wellbore and the casing to seal off the gas producing layer. However, there are certain problems which arise in this situation. It is these problems that the present invention specifically addresses, namely to substantially improve the initial placement of the cement slurry, to prevent the penetration of gas into a cement slurry during setup of the cement, to improve bond logs and to improve remedial cementing operations.

Figure 2:
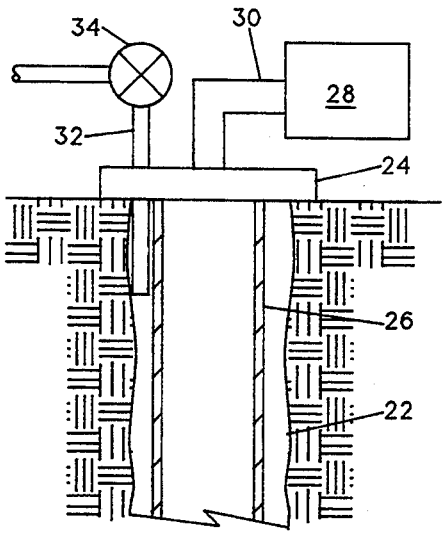
FIG. 2 is a schematic side elevation partly in section, showing one embodiment for carrying out the present invention.
Figure 3:
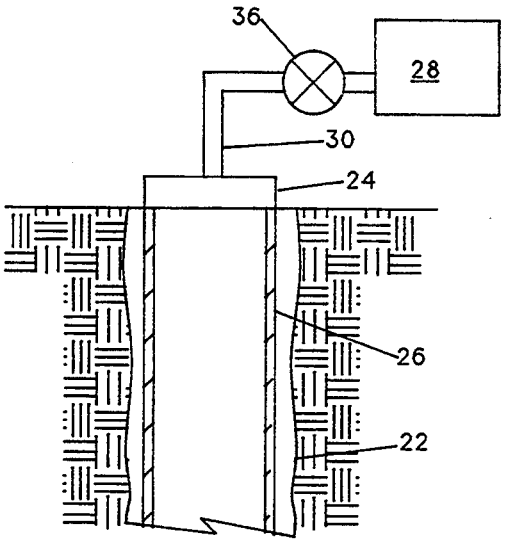
FIG. 3 is a schematic side elevation partly in section, showing another embodiment for carrying out the present invention.
Figure 4:
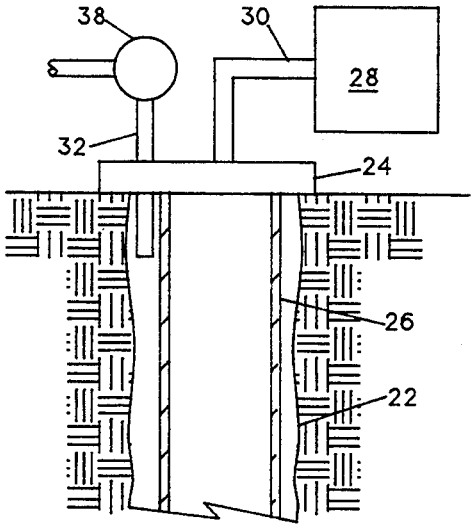
FIG. 4 is a schematic side elevation partly in section, showing yet another embodiment for carrying out the present invention.

Three techniques for accomplishing the present invention are shown in schematic form in FIGS. 2 to 4. Each technique is often more applicable to one type of situation rather than having universal application. For example, the technique shown in FIG. 2 applies primarily to the improvement of cement placement where casing is initially cemented in place. In FIG. 2, the annulus between the casing and well bore 22 is provided with a seal 24 substantially sealing the upper end of the casing 26. The cement slurry is fed from a source 28 to the well via a conduit 30. The seal is also provided with a vent 32 having valve means 34 therein. This embodiment of the invention would operate by opening and closing the valve 34 in either a periodic or random fashion so as to alternate the pressure within the annulus 22. Thus a pressure pulse would be applied to the fluid within the annulus.

FIG. 3 shows a slightly different arrangement in which a valve or pump 36 is placed between the wellhead seal 24 and the cement slurry source 28 to pulsate the feed of the slurry to the well annulus 22. This technique would be more applicable to initially cementing casing and for remedial cementing operations.

FIG. 4 is somewhat of a variant of FIG. 2 in that a pump 38 is provided in place of the previous vent valve. This technique would be more applicable to preventing gas migration and improving bond logs after the cement has been placed in the annulus. The pump is used to periodically pulsate the pressure in the well by either alternately pressurizing the well or partially evacuating it. Each of these embodiments would be provided with means (not shown) to selectively activate the respective valve or pump is suitable manner to produce the desired sequence.

Figure 5:
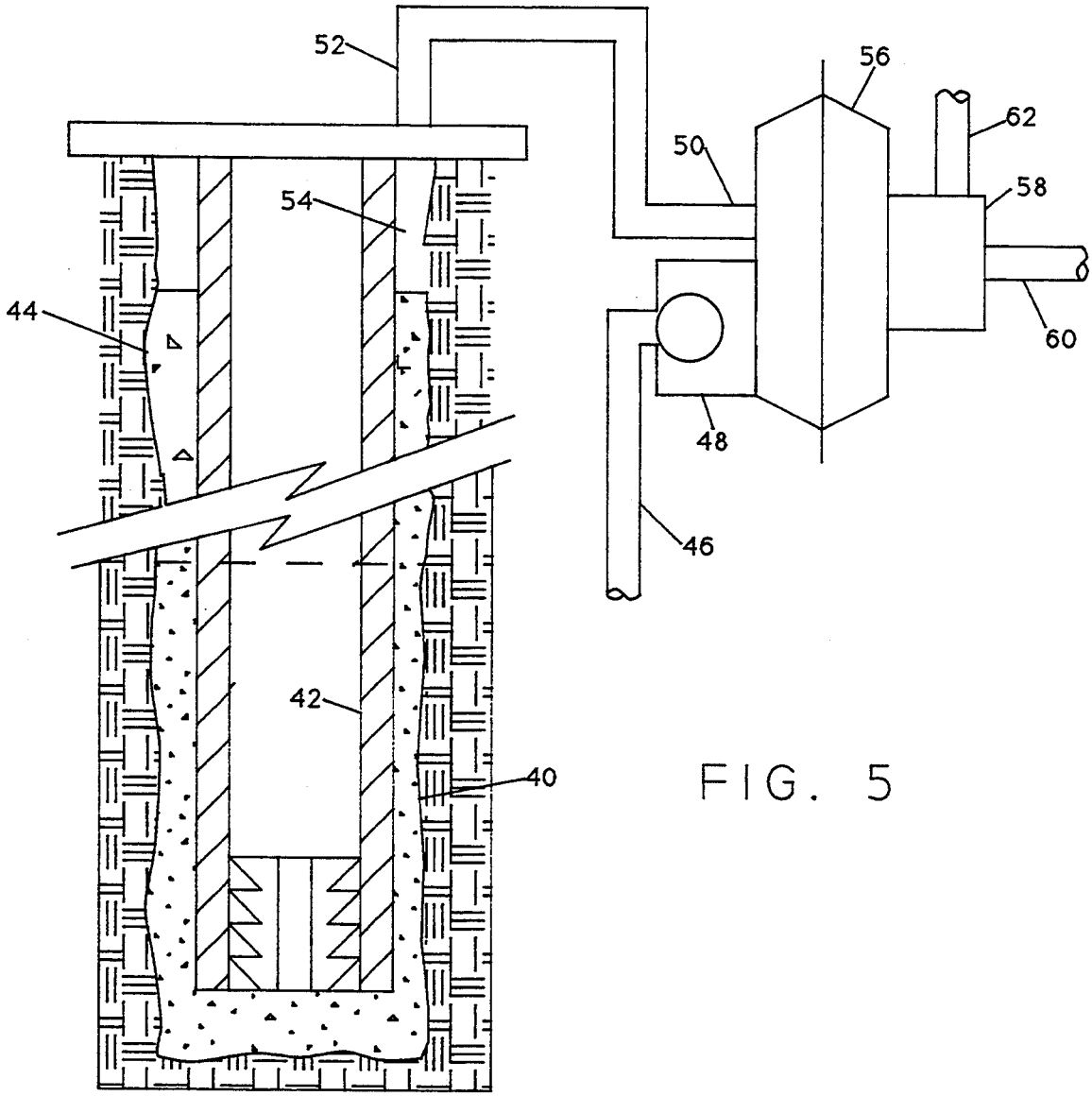
FIG. 5 is a schematic side elevation partly in section, showing a further embodiment for carrying out the present invention.

A more specific technique for preventing gas migration and improving bond logs is shown in FIG. 5. The device shown in the illustration is essentially a single acting air driven diaphragm pump, but without the discharge valve necessary to pump fluid. The resulting device would impart an oscillatory motion to the fluid. The retention of an intake valve would maintain the level of fluid in the wellbore making up for any fluid loss. The frequency of oscillation could be adjusted to cause a resonant motion of the fluid in the well annulus. This example might also provide a static pressure component due to the inertial effects of the column of fluid. If this type of device was connected to the outlet of a separate conventional pump, used to maintain a constant pressure, an intake valve would not be necessary.

The present invention is shown in schematic form in FIG. 5 where a wellbore 40 has a casing 42 therein which is provided with cement 44. Water from a source (not shown) passes through an inlet 46, through an inlet valve 48, outlet port 50 and conduit 52 to the annulus 54. A diaphragm 56, controlled by an air controller 58, having an air inlet 60 connected to an air source (not shown) and an air exhaust 62, controls the pressure applied to the annulus 54.

When this device is attached to a well, it would impart an oscillating motion to the cement slurry that would be transmitted down the column of cement in the annulus to prevent gelation. This would put the cement slurry on a more intimate contact with the casing as it made the transition from a liquid slurry to a solid and improve the bond between the cement and casing. This would also prevent the loss of hydrostatic pressure that leads to gas migration problems. Only modest power inputs might be required, especially if resonance could be obtained to maintain the cement slurry in a liquified state by this method.

The pump shown in the FIG. 5 could be a modified commercially available double acting air driven diaphragm pump. Such pumps are very compact and light in weight, compared to their displacement, and can be driven by the air compressors normally available at a rig. They are readily available and are relatively inexpensive. When cement placement is completed, the annulus is closed at the surface by any known annular blowout preventer and the output of the subject device connected to communicate with the annulus through a surface casing valve. It would be started up, adjusted, and most probably could operate unattended until the cement has set up.

Squeeze cementing, as well as primary cementing, may benefit from pressure oscillation when the cement slurry is placed. The need for good pipe and formation bond and for minimizing fluid movement after cement placement is particularly desirable when cementing holes in casing and when "block" squeezing to correct or repair deficiencies in the primary cement seal.

Casing holes often require multiple cement squeeze operations before repair is effective and this is costly compared to other remedial cementing. High bond strength in the very limited area of contact between the cement and casing wall is critical to the success of hole repair.

The equipment used to apply pressure oscillation during and after squeezing could vary from that used in primary cementing. The same air diaphragm pump could be used when pressures are low, such as in cement placement for shallow hole repair where high squeeze pressures are not developed. For higher pressures a modified diaphragm or plunger pump would suffice, possibly in conjunction with a pressure dump valve to unload or pulse under higher pressure.

There are many advantages which can be obtained by oscillating the pressure while cementing a casing. When pockets of gelled, semi-solid, drilling fluid in the well are exposed to an oscillating pressure, the shear forces generated within the semi-solid break up the gel structure and the semi-solid in these pockets reverts to a fluid. The resulting mobile fluid mixes with the rest of the flow and the isolated volume or pocket disappears.

When a cement slurry is pumped into the well, it is now free to flow into the volume formerly occupied by these pockets, improving mud displacement by the cement slurry. This results in an improved cementing operation.

There are many means available for pulsating or randomly varying the pressure. A pulsating fluid pressure can be provided much more easily than the techniques representing the current state of the art to improve the drilling fluid displacement by cement slurries. Fluid pressure oscillations or vibrations could be imparted to the fluid being pumped into the well, to the fluid coming out of the well, or both. In either case, a stream of flowing fluid, containing a considerable amount of energy as a consequence of this flow, is available when the cement is pumped.

Fluid oscillation could be accomplished by using a fraction of this energy to provide a controlled regular or irregular pulsating, oscillating or vibrating flow. This could be accomplished with a device that periodically constricts or shuts off the flow of fluid, then releases the flow in a controlled fashion, to provide the desired periodicity, amplitude and shape of fluid pressure oscillations.

On the outlet side of the well, this might be accomplished by means of a special valve. Means would be required to close off the annulus around the casing at the surface and to direct the flow of fluid through this valve. Each time the valve is closed, pressure will momentarily build up inside the well, as a consequence of the cement slurry flowing into the well. In this case the compressibility of the large volume of fluids generally inside the casing and the well bore and the expansion properties of the well bore would act as a pressure accumulator. Their combined effect would generally allow a substantial flow into the well without an uncontrollable increase in the pressure. When the valve was opened, the pressure would rapidly decline. If this sequence is repeated as a rapid, precisely controlled succession of events, oscillation or vibration of the fluid would result.

An alternative device might be attached between the cement pump and the cementing head. In this case, the pressure rise would be extremely rapid if the flow from the pump was shut off completely, because of the small volume of compressible fluid and the rigidity of the pump outlet and pipes. If this was not a desirable condition, a mechanical pressure accumulator and/or special valve that did not completely stop the flow might be used to control this pressure rise. A properly designed device could provide a very precise control of the rise time, frequency and the amplitude of the waves transmitted into the well.

An external source of energy that did not depend on the flow of fluid might also be used. Devices based on a modified piston, plunger or diaphragm pumps could also be used. For this application, the oscillator could have an inlet valve and be connected to a source of fluid to maintain the level of fluid in the annulus during this operation. During the displacement stroke, the pump would compress the fluid, sending a compression wave down the annulus. During the intake stroke, if there was no check valve on the pump outlet, fluid could flow back into the pump, creating a rarefaction wave. If the pump had an inlet check valve, then fluid could flow into the pump during the intake stroke to maintain fluid in the annulus during this operation. Note that a cam operated inlet valve might be used to optimize the formation of the rarefaction wave and to maintain fluid in the annulus during the pump inlet stroke.

A special device might be made to impart pulses with a very short rise time. It could be attached to the cement line between the cement pump and the cementing head placed on the top of the casing. It could consist of an air powered piston, plunger or diaphragm. For example, an air powered plunger might start in a retracted or cocked condition with its cylinder full of fluid at the beginning of a pulse. If the piston was suddenly released, it would accelerate rapidly to expel the fluid back into the flowing stream of fluid and impart a sharp short duration increase in pressure. The piston could be retracted and accelerated in a periodic or random fashion.

The amplitude and frequency imparted to the fluid is affected by the displacement and the frequency of reciprocation of the fluid oscillator. If the device is based on a crankshaft driven pump, controlling the crankshaft rotational speed would control the frequency of the oscillations. The amplitude could be controlled by the displacement of the device. This might be modified by controlling the length of the stroke and/or by the use of a pulse damper, etc.

The pressure waves transmitted down the wellbore and reflected back up might be detected at the surface with appropriate pressure sensing equipment. Very sensitive equipment might be used to deduce a large amount of information concerning the position and movement of the different types of fluids during and after the cement placement operation. This information might be used to focus energy in selected volumes during this operation, by adjusting the properties of the fluid oscillation at the surface, to cause resonance in the selected volumes.

When the cement slurry has been pumped into place in the annulus between the casing and well bore, it turns from a liquid slurry into a competent solid in a matter of a few hours. Water is consumed during this process and the volume of the slurry decreases slightly as a result of the hydration reactions that cause this transformation. This decrease in volume, together with the development of gel strength, causes a Loss of hydrostatic pressure. During this process, the weight of the fluid is no longer uniformly transmitted throughout the fluid. It becomes suspended from the surface of the casing and the well bore.

As stated above, under certain conditions the pressure may decline enough that formation fluids, usually gas, invades the cement before it has developed enough viscosity to resist this flow. The result varies from gas cut cement that prevents the economic control of produced fluids, to blowouts to the surface that may pose a serious threat to the rig crew and equipment.

Applying periodic or random pressure pulses to the cement slurry from the surface, during the transition from a liquid slurry to a solid, delays the loss of hydrostatic pressure until the viscosity of the cement prevents fluids from invading the cement. As stated above, periodic or random pressure pulsing of the slurry from the surface is much simpler to accomplish than vibrating or rotating the casing.

Periodic or random pressurizing of the slurry from the surface has an additional advantage. It continues to oscillate cement slurry that is still in a fluid or semi-fluid state, but when the cement begins to solidify, the propagation of this effect through the solid will be drastically reduced. As stated above, the cement setting process generally starts at the bottom of the well bore and proceeds upwards as a result of the normal temperature gradient in the well. As a result, as the cement in the bottom of the well hardens and no longer requires oscillation to prevent fluid migration, the oscillation ceases by virtue of this same hardening or solidification process. However, the cement in shallower regions of the well, that may not have hardened due to the lower temperature, will still be coupled to the source of the pressure pulses from the surface. This will continue to maintain the hydrostatic pressure and prevent the influx of fluids until the cement at the shallower depths, in turn, solidifies.

After the cement has been placed, it remains in a generally static condition as it sets up. As a result, any device used to oscillate the pressure cannot rely on the flowing fluids or slurries that occur during the placement of the cement to provide the energy for oscillating the fluid. A separately powered device will generally need to be used.

The amplitude and frequency of pressure oscillations may or may not be critical. Pressure transducers may be attached to the oscillator outlet to monitor the amplitude and frequency of the transmitted and reflected pressure waves. As described above, the reflected waves may be used to focus the energy of the waves in certain areas of the wellbore and to monitor the condition of the fluids with time.

As noted above, although there may be operational advantages to locating pressure wave generators and sensors on the surface, this invention is not limited to this condition.

As discussed above, when the cement changes from a liquid slurry to a solid, it goes through a semi-solid phase that has some of the properties of both liquids and solids. As it begins to lose the properties of a gel and become solid, it continues to decrease in volume. This decrease causes the cement to pull away from the casing, causing a microannulus to form. If the cement is vibrated during this transition, it improves the contact or bonding between the cement and the casing. This improvement in the bond, in turn, makes the result of the bond log more representative of the quality of the cementing operation.

To improve the bond log, the basic methods of oscillating the fluid would be the same as described to prevent gas migration. The frequency, amplitude, and wave shape and time of application may be specifically tailored to provide the maximum benefit to the bond log.

The technique of transmitting waves down the well bore from the surface and measuring reflected waves provides the basis for an improved test to evaluate the placement of the cement compared to a cement bond log. The application of this invention would involve sending compression waves down the annulus from the surface and detecting the waves reflected from the surface of the hardening cementing.

As stated above, the cement generally becomes a solid at the bottom of the well first, because of the higher temperature. The solidification process then moves up the well. The reflection of pressure waves from this surface of setting cement could be used to monitor the setting process and the progression of this process up to well could be used to evaluate the completeness with which the drilling fluid was replaced by the cement slurry.

As an alternative method to evaluate cement placement, a specially designed system incorporating appropriate oscillator and pressure transducer components would probably optimize the use of this approach as a measuring tool. It is likely that a carefully designed device should prevent gas migration and evaluate cement placement at the same time.

During remedial squeeze cementing operations, the objective is usually to flow a liquid cement slurry into a space occupied by gelled drilling fluid. The success of the operation depends on the ability of the cement slurry to uniformly displace the drilling fluid away from the point of entry of the cement slurry. In practice, the cement tends to channel or finger through the mud as described above. Oscillation reduces the gel strength of the mud allowing the cement to spread out. This improves displacement and improves the success ratio of remedial cement squeeze operations.

The means for oscillating the pressure would be substantially the same as was described above for cementing casing. The flow rates during remedial cement squeezes are usually very low and the flowing stream of fluid may not produce enough energy to oscillate the fluids. In this case, a separate source of driving energy, as described above, may be preferable.

The present invention may be subject to many modifications and changes without departing from the spirit or essential characteristics thereof. The present embodiments are therefore intended in all respects as being illustrative and not restrictive of the scope of the invention as defined by the appended claims.

We claim:

1. A method of improving cement bonds and/or preventing gas migration in cement slurries during set up comprising the step of:

applying pulsated pressure from the surface to a fluid mixture in an annulus between a wellbore and a casing positioned therein, said fluid mixture containing said cement slurry, said pulsed pressure being applied during substantially the entire setting operation.

2. The method according to claim 1 wherein said pulsated pressure has a periodic component.

3. The method according to claim 1 wherein said pulsated pressure has an oscillating component.

4. The method according to claim 1 wherein said pulsated pressure has a random component.

5. The method according to claim 1 wherein said pulsated pressure is applied to the surface of said slurry.

6. An apparatus for improving cement bonds and/or preventing gas migration in cement slurries during set up comprising:

means to apply pulsated pressure from the surface to fluid in an annulus between a wellbore and a casing, said fluid containing said cement slurry, throughout substantially the entire setting process.

7. An apparatus according to claim 6 wherein said means to apply pulsated pressure is located at the surface of the wellhead.

8. An apparatus according to claim 6 wherein said means to apply pulsated pressure is located downhole in the vicinity of the cementing operation.

9. An apparatus according to claim 6 wherein said means to apply pulsated pressure varies the pressure in the annulus between the wellbore and casing.

10. An apparatus according to claim 6 wherein said means to apply pulsated pressure controls exhaust from said annulus between the casing and wellbore.

11. An apparatus according to claim 6 wherein said means to apply pulsated pressure controls feed of slurry to said annulus between the casing and wellbore.

12. A method to displace drilling mud in the annulus between a wellbore and casing during a cementing operation comprising the step of:

applying pulsated pressure from the surface to the fluid in an annulus between a wellbore and a casing, said fluid containing a cement slurry, said pulsated pressure being applied during substantially the entire cementing operation whereby gelation of the drilling mud is substantially eliminated.

13. The method according to claim 12 wherein said cementing is a primary cementing operation.

14. The method according to claim 12 wherein said cementing is a remedial cementing operation.

15. A method for monitoring the a cementing operation comprising the steps of:

applying pulsed pressure to a cement slurry in an annulus between a wellbore and a casing positioned therein, said pulsed pressure causing a detectable reflected pulse from a hardening interface within said cement slurry; and examining said reflected pulses whereby it is possible to determine the position within the annulus of a plug formed by said cement slurry and progress of cement set up.

* * * * *